US010711988B2

(12) United States Patent
Sieczkowski et al.

(10) Patent No.: US 10,711,988 B2
(45) Date of Patent: Jul. 14, 2020

(54) LIGHT FIXTURE WITH ADJUSTABLE CONNECTOR

(71) Applicant: ABL IP Holding LLC, Decatur, GA (US)

(72) Inventors: Philip Sieczkowski, Lawrenceville, GA (US); Christina Mayo, Augusta, GA (US)

(73) Assignee: ABL IP Holding LLC, Atlanta, GA (US)

( * ) Notice: Subject to any disclaimer, the term of this patent is extended or adjusted under 35 U.S.C. 154(b) by 163 days.

(21) Appl. No.: 15/704,207

(22) Filed: Sep. 14, 2017

(65) Prior Publication Data

US 2018/0142876 A1 May 24, 2018

Related U.S. Application Data

(60) Provisional application No. 62/424,142, filed on Nov. 18, 2016.

(51) Int. Cl.
*F21V 23/06* (2006.01)
*F21V 21/005* (2006.01)
(Continued)

(52) U.S. Cl.
CPC ..... *F21V 23/06* (2013.01); *F21S 4/28* (2016.01); *F21V 7/0016* (2013.01); *F21V 15/015* (2013.01); *F21V 19/02* (2013.01); *F21V 21/005* (2013.01); *F21V 21/15* (2013.01); *F21V 23/004* (2013.01); *H01R 13/22* (2013.01);
(Continued)

(58) Field of Classification Search
CPC ..... F21V 23/06; F21V 21/005; F21V 23/004; F21V 7/0016; F21V 15/015; F21V 19/02; F21V 21/15; F21S 4/28; H01R 35/04; H01R 13/22; H01R 33/92; H01R 33/94; H01R 24/78; H01R 2103/00; F21Y 2115/10; F21Y 2103/10
See application file for complete search history.

(56) References Cited

U.S. PATENT DOCUMENTS 3,837,607 A * 9/1974 Hesse ..... F21S 8/033 248/278.1
4,719,314 A 1/1988 Nothnagel et al.
(Continued)

FOREIGN PATENT DOCUMENTS

EP 1433977 A2 6/2004

OTHER PUBLICATIONS

Canada Patent Application No. 2,979,467 received an Office Action dated Dec. 19, 2018, 6 pages.
(Continued)

*Primary Examiner* — Britt D Hanley
*Assistant Examiner* — Fatima N Farokhrooz
(74) *Attorney, Agent, or Firm* — Kilpatrick Townsend & Stockton LLP

(57) ABSTRACT

Light fixtures for a wide range of installations that can be interconnected to each other in different orientations to permit easy scaling up or down of an installation without requiring renovation or disruption of the surrounding environment. More specifically, embodiments of the light fixtures include an adjustable power connector that can be oriented differently depending on the desired configuration of the installation.

10 Claims, 15 Drawing Sheets

(51) Int. Cl.

| | |
|---|---|
| ***F21S 4/28*** | (2016.01) |
| ***F21V 7/00*** | (2006.01) |
| ***F21V 15/015*** | (2006.01) |
| ***F21V 19/02*** | (2006.01) |
| ***F21V 21/15*** | (2006.01) |
| ***F21V 23/00*** | (2015.01) |
| ***H01R 13/22*** | (2006.01) |
| ***H01R 33/92*** | (2006.01) |
| ***H01R 35/04*** | (2006.01) |
| *H01R 33/94* | (2006.01) |
| *H01R 24/78* | (2011.01) |
| *H01R 103/00* | (2006.01) |
| *F21Y 103/10* | (2016.01) |
| *F21Y 115/10* | (2016.01) |

(52) U.S. Cl.
CPC ..... *H01R 33/92* (2013.01); *H01R 35/04* (2013.01); *F21Y 2103/10* (2016.08); *F21Y 2115/10* (2016.08); *H01R 24/78* (2013.01); *H01R 33/94* (2013.01); *H01R 2103/00* (2013.01)

(56) References Cited

U.S. PATENT DOCUMENTS

| | | | | |
|---|---|---|---|---|
| 4,959,021 | A | 9/1990 | Byrne | |
| 5,390,433 | A | 2/1995 | Brady | |
| 5,658,152 | A | 8/1997 | Selker | |
| 6,152,639 | A | 11/2000 | Hsu | |
| 6,551,142 | B2 | 4/2003 | Eisenbraun | |
| 6,750,410 | B2 | 6/2004 | Lee | |
| 6,913,467 | B2 | 7/2005 | Huang | |
| 6,921,182 | B2 | 7/2005 | Anderson, Jr. et al. | |
| 7,497,740 | B2 | 3/2009 | Mei et al. | |
| 7,614,902 | B2 | 11/2009 | Bayat et al. | |
| 8,523,385 | B2 | 9/2013 | Lu et al. | |
| 8,662,902 | B1 | 3/2014 | Lai | |
| 9,206,970 | B2 | 12/2015 | Halliwell et al. | |
| 9,325,134 | B2 | 4/2016 | Lopez et al. | |
| 9,335,009 | B2 | 5/2016 | Halliwell | |
| 9,438,017 | B2 | 9/2016 | Irons et al. | |
| 2008/0239730 | A1* | 10/2008 | Chien | F21L 14/02 362/368 |
| 2009/0103331 | A1* | 4/2009 | Pazula | H01R 33/94 362/649 |
| 2009/0288340 | A1 | 11/2009 | Hess | |
| 2010/0277078 | A1 | 11/2010 | Morton | |

OTHER PUBLICATIONS

Belkin, "Belkin 12-Outlet Pivot-Plug Power Strip Surge Protector with 8-Foot Power Cord, 4320 joules (BP112230-08)," retrieved from https://www.amazon.com/Belkin-12-Outlet-Pivot-Plug-Protector-BP112230-08/dp/B000JE9LD4/ref=pd_lpo_60_tr_t_3?ie=UTF8&psc=1&refRID=VBNQFDHSRKVZBTKB26GP, Jul. 2, 2007, 10 pages.

Chi, "Chi Original 1" Flat Hair Straightening Ceramic Hairstyling Ir 1 Inch Plates, retrieved from https://www.amazon.com/CHI-Original-Ceramic-Tourmaline-Straightener/dp/B0009V1YR8, 2005, 7 pages.

Feit Electric, "2 ft. 2-Light 19-Watt White LED Hydroponic Linkable Grow Light," retrieved from https://www.homedepot.com/p/Feit-Electric-2-ft-2-Light-19-Watt-White-LED-Hydroponic-Linkable-Grow-Light-74303/206384743, 2016, 4 pages.

Feit Electric, "2 ft. 2-Light 19-Watt White LED Full Spectrum Linkable Grow Light," retrieved from https://www.homedepot.com/p/Feit-Electric-2-ft-2-Light-19-Watt-White-LED-Full-Spectrum-Linkable-Grow-Light-74302/206384735, 2016, 5 pages.

Globe Electric, "3 Outlet Lateral Swivel Grounded Wall Adapter Tap, White Finish, Globe Electric 46505," retrieved from https://www.amazon.com/Lateral-Grounded-Globe-Electric-46505/dp/B007XQORTO, May 7, 2012, 9 pages.

Master Electrician, "Master Electrician ME903105 6 Outlet 2160 Joule Rotating Surge Tap, White" retrieved from https://www.amazon.com/Master-Electrician-ME903105-Outlet-Rotating/dp/B00827D60E, May 11, 2012, 6 pages.

PLATINUMLED Grow Lights, "Advanced Platinum Series P150 150w 12-band LED Grow Light-Dual VEG/Flower Full Spectrum" retrieved from https://www.amazon.com/Advanced-Platinum-P150-12-band-Grow/dp/B00NTBVEGQ, 2015, 11 pages.

Quail Electronics, Inc., "Rotating Wall Tap: 0700.W!," Quail Electronics, retrieved from http://www.quail.com/new_products.aspx, 2012, 1 page.

Tripp Lite, "Tripp Lite 6 Rotatable Outlet Surge Protector/Suppressor, Wall Mount Direct Plug-In, & $20k Insurance (SWIVEL6)," retrieved from https://www.amazon.com/Tripp-Lite-Rotatable-Suppressor-SWIVEL6/dp/B000UD3NTC/ref=pd_lpo_60_Ip_t_4?ie=UTF8&psc=1&refRID=VBNQFDHSRKVZBTKB26GP, Oct. 2, 2001, 10 pages.

* cited by examiner

LIGHT FIXTURE WITH ADJUSTABLE CONNECTOR

CROSS-REFERENCE TO RELATED APPLICATIONS

This application claims the benefit of U.S. Provisional Application No. 62/424,142, filed Nov. 18, 2016 and entitled "Light Fixture with Adjustable Connector," the entirety of which is hereby incorporated by reference.

FIELD OF THE INVENTION

Embodiments of the present invention are directed to a light fixture equipped with an adjustable power connector to facilitate electrical connection to other light fixtures.

BACKGROUND

Designing light fixtures that can be universally used for promoting plant and flower growth has proved challenging. Because the variety and size of the plants can vary widely, there is a large disparity in end use locations and scale requirements for different installations. Reasonably priced, easily scalable lighting systems have not been readily available for hobbyists and small-scale horticultural operations.

SUMMARY

Embodiments of the present invention provide light fixtures for a wide range of installations that can be interconnected to each other in different orientations to permit easy scaling up or down of an installation without requiring renovation or disruption of the surrounding environment. More specifically, embodiments of the light fixtures include an adjustable power connector that can be oriented differently depending on the desired configuration of the installation.

The terms "invention," "the invention," "this invention" and "the present invention" used in this patent are intended to refer broadly to all of the subject matter of this patent and the patent claims below. Statements containing these terms should not be understood to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to the entire specification of this patent, all drawings and each claim.

DETAILED DESCRIPTION

Figure 1:
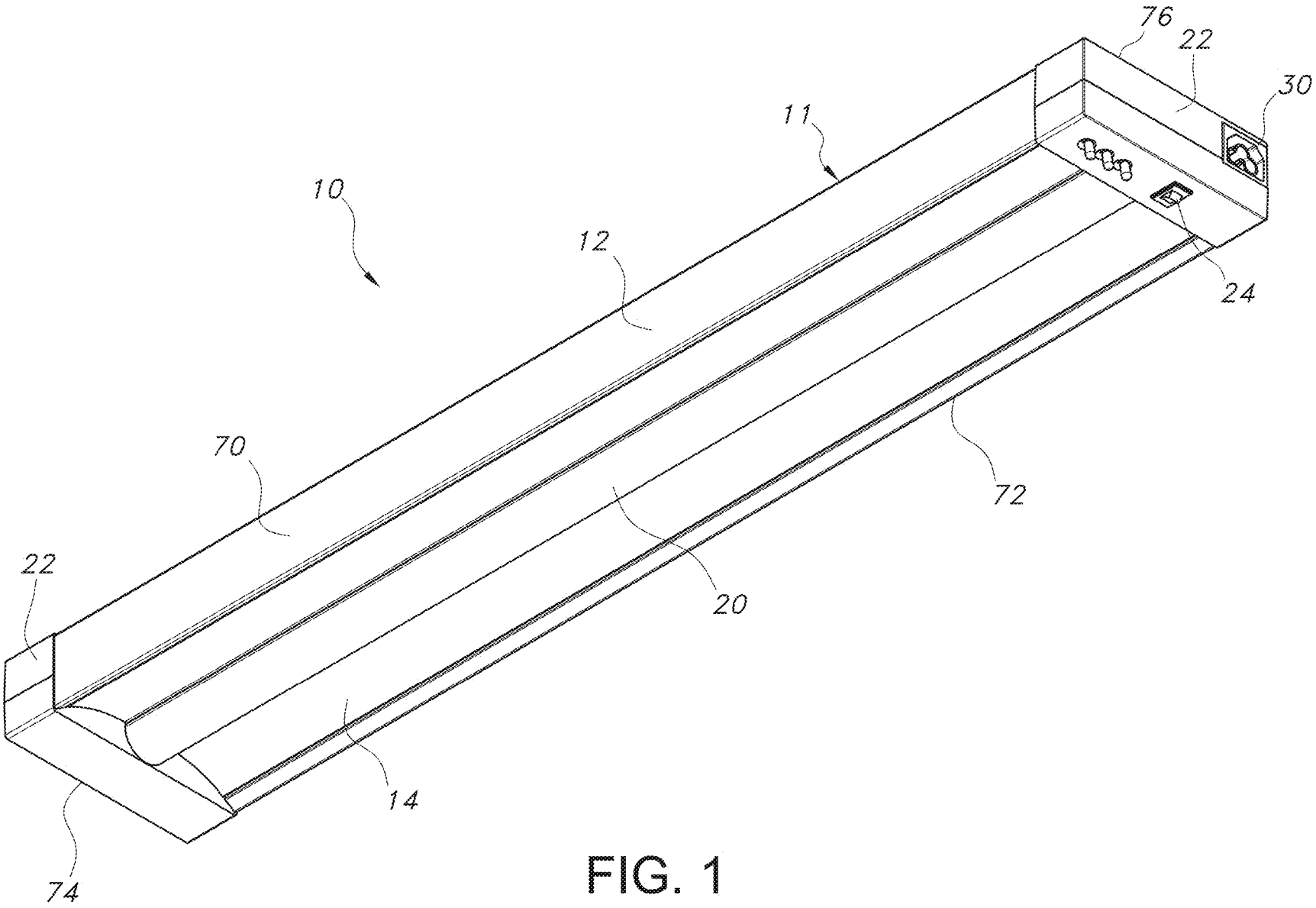
FIG. 1 is a bottom perspective view of an embodiment of a light fixture contemplated herein.
Figure 2:
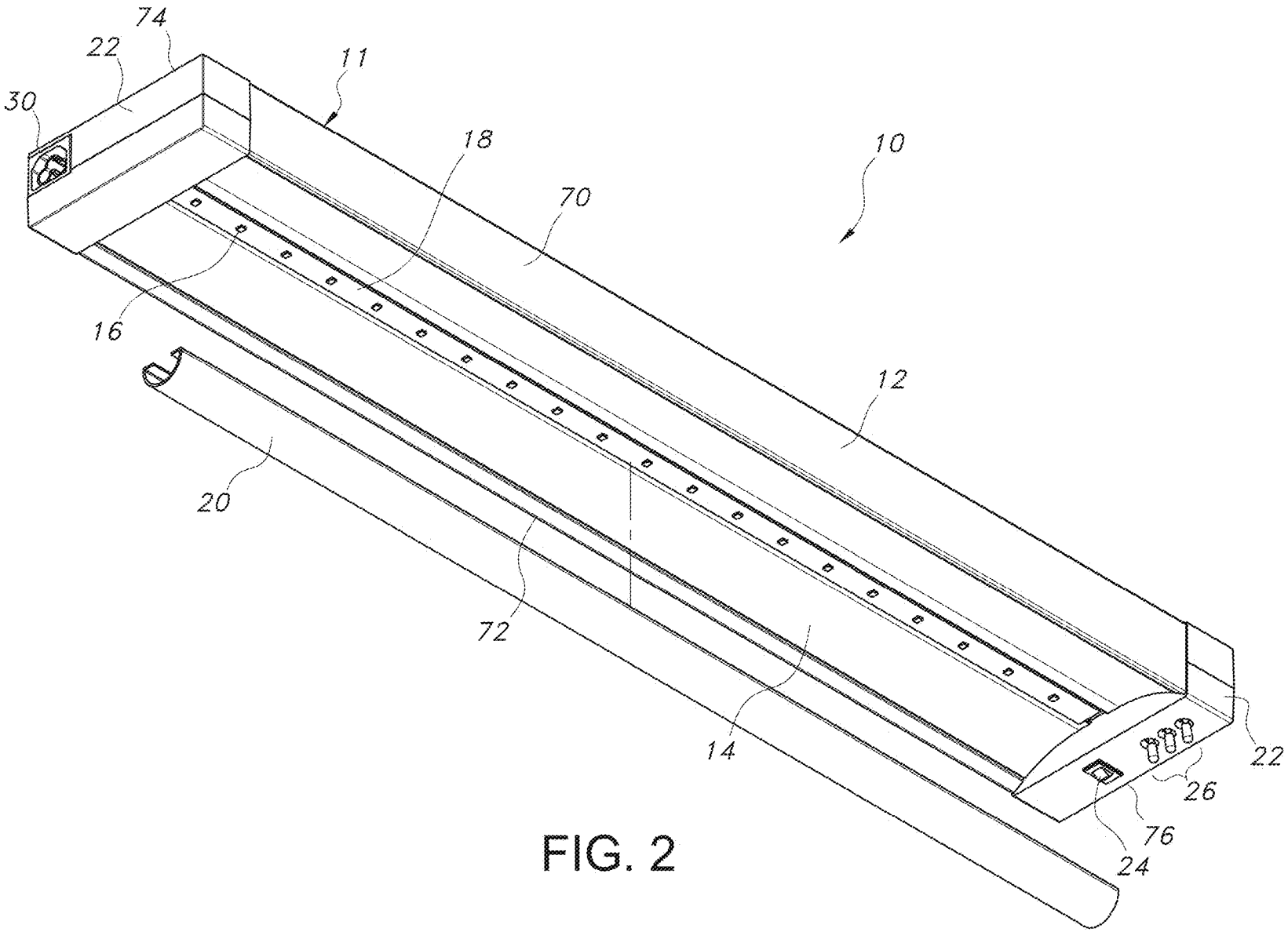
FIG. 2 is an exploded bottom perspective view of the light fixture of FIG. 1.
Figure 3:
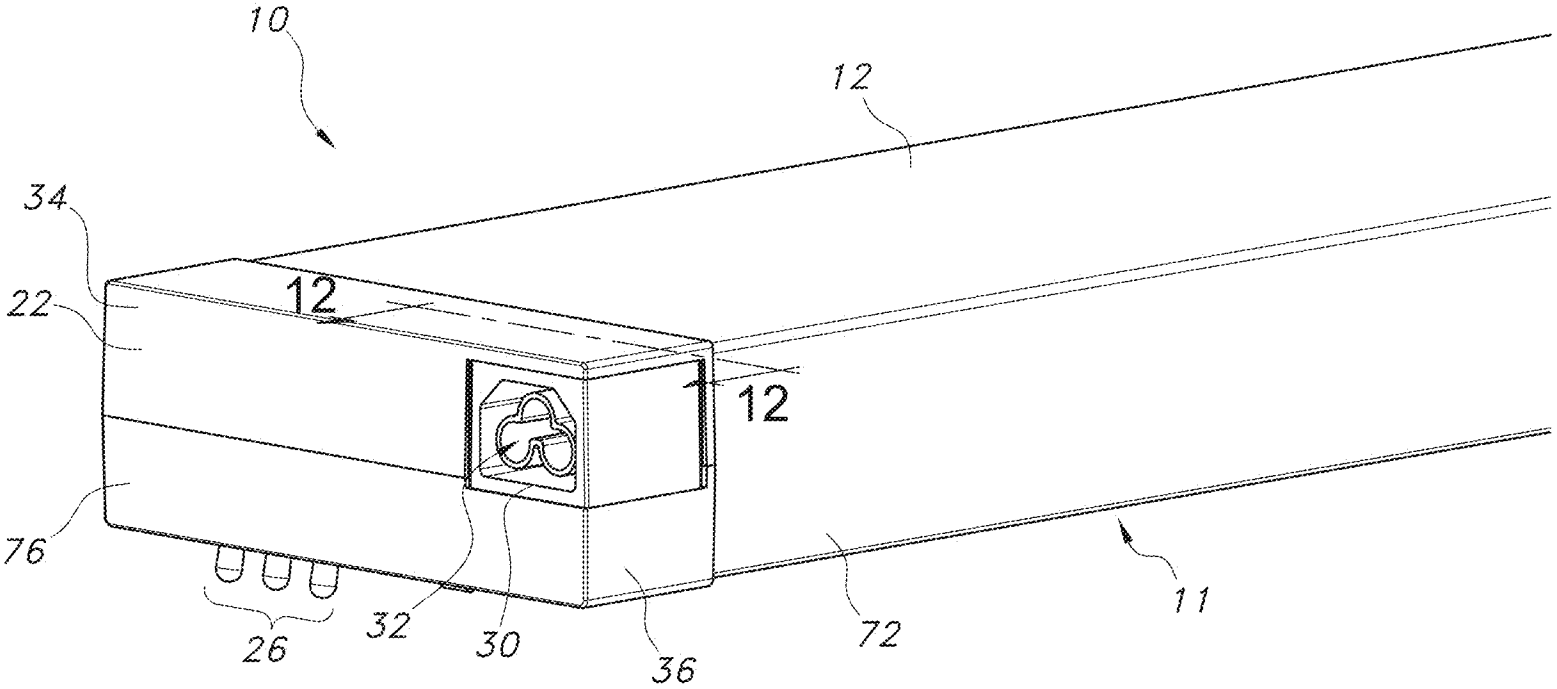
FIG. 3 is a top perspective view of the light fixture of FIG. 1 with an adjustable power connector oriented in a first orientation.
Figure 4:
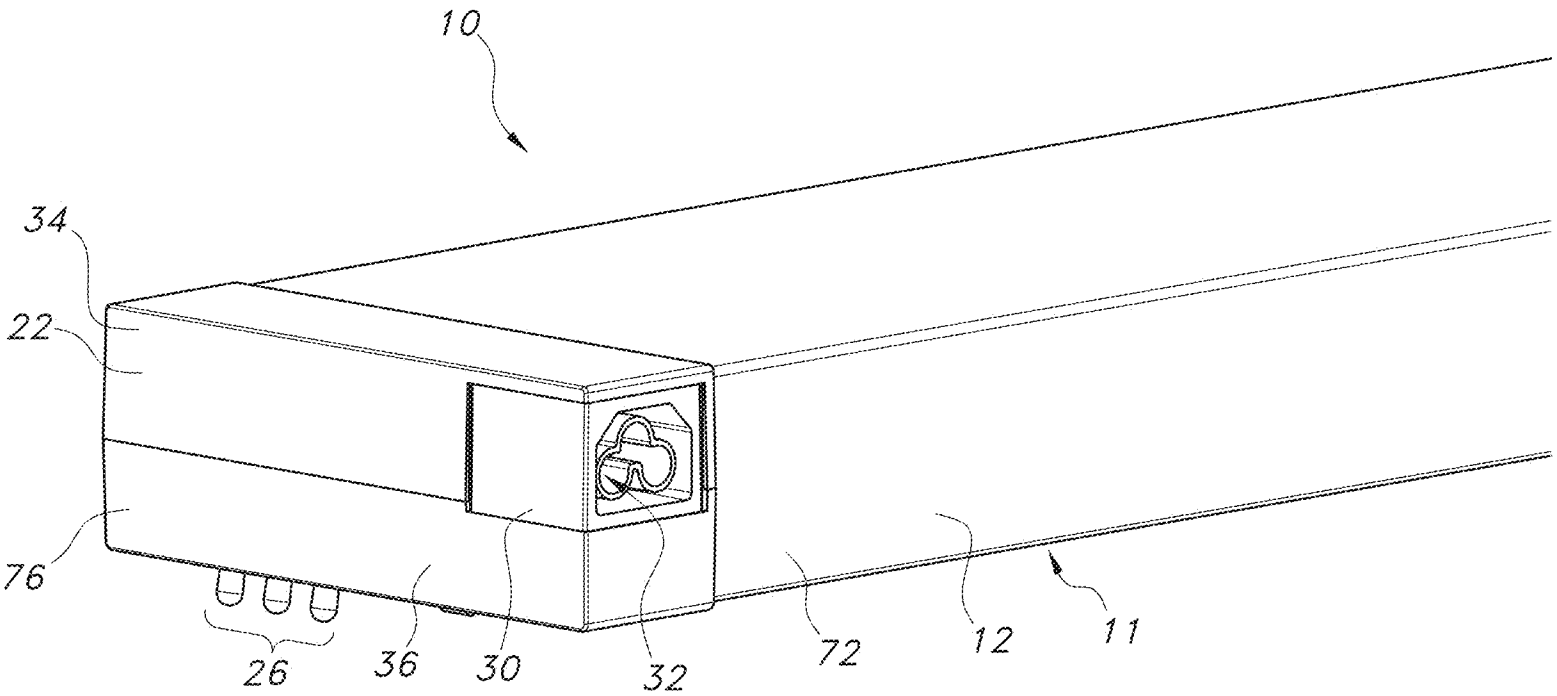
FIG. 4 is a top perspective view of the light fixture of FIG. 1 with the adjustable power connector oriented in a second orientation orthogonal to the first orientation of FIG. 3.

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

Generally speaking, embodiments of the light fixture disclosed herein include at least one power connector, the position of which can be adjusted on the fixture such that the connector can be used to connect the light fixture to other light fixtures in different configurations. While embodiments are disclosed for use in fixtures for promoting plant and flower growth, the power connector disclosed herein may be incorporated in any type of fixture designed for any intended use.

In one embodiment (see FIGS. 1-4), the light fixture 10 includes a housing 11 that includes a channel 12 in which is positioned a reflector 14. The channel 12 and reflector 14 may be formed of any suitable materials, including metallic and polymeric materials. The surface of the reflector 14 preferably has an extremely high surface reflectivity, preferably, but not necessarily, between 96%-99.5%, inclusive and more preferably 98.5-99%. To achieve the desired reflectivity, in one embodiment the reflector surface comprises polished metals such as, but not limited to, polished aluminum. In other embodiments, reflective coatings, including reflective paints or other reflective compositions, are applied to the reflector to attain the desired reflectivity.

A plurality of light sources (e.g., LEDs 16) extend along the reflector 14 and are interposed between the downwardly-extending walls of the reflector 14. The LEDs 16 may be mounted on a printed circuit board 18 ("PCB") that is subsequently attached to the reflector 14 or other mounting substrate. However, in other embodiments, a PCB is not needed; rather, the LEDs 16 are chip-on-board LEDs provided directly on the reflector 14 or other mounting substrate. Any number of light sources may be provided and positioned within the light fixture 10 in any configuration (columns, rows, random, etc.).

An optic 20 (lens, diffuser, etc.) is positioned over the LEDs 16 to direct the emitted light as desired. The optic 20 may be of any type (clear, diffuse, prismatic, etc.) that achieves the desired light emission from the fixture. The optic 20 may have any geometry and may be provided with any surface enhancements or no surface enhancements.

The housing 11 further includes ends caps 22 that are mounted on the ends of the channel 12. The end caps 22 may be formed of any suitable materials, including metallic and polymeric materials. In some embodiments, the end caps 22 are molded polymeric end caps. Collectively, the channel 12 and end caps 22 define opposing side walls 70, 72 and end walls 74, 76 of the housing 11. While the housing 11 is illustrated a having a separate channel 12 and end caps 22, it is contemplated that the housing 11 may be a single, monolithic structure.

Different colored LEDs 16 may be provided in the fixture 10. Light emitted from the fixture 10 having wavelengths of 400-700 nanometers (i.e., photosynthetically active radiation) is believed most effective for optimizing plant and flower growth. In some embodiments, a plurality of red, white, and blue LEDs 16 are provided in the fixture 10. It has been found that exposure to red light may contribute to root growth, flowering, blooming, and fruiting while exposure to blue light may contribute to vegetation growth or leafing on the plants. White light, in turn, provides general illumination to the space.

Figure 5:
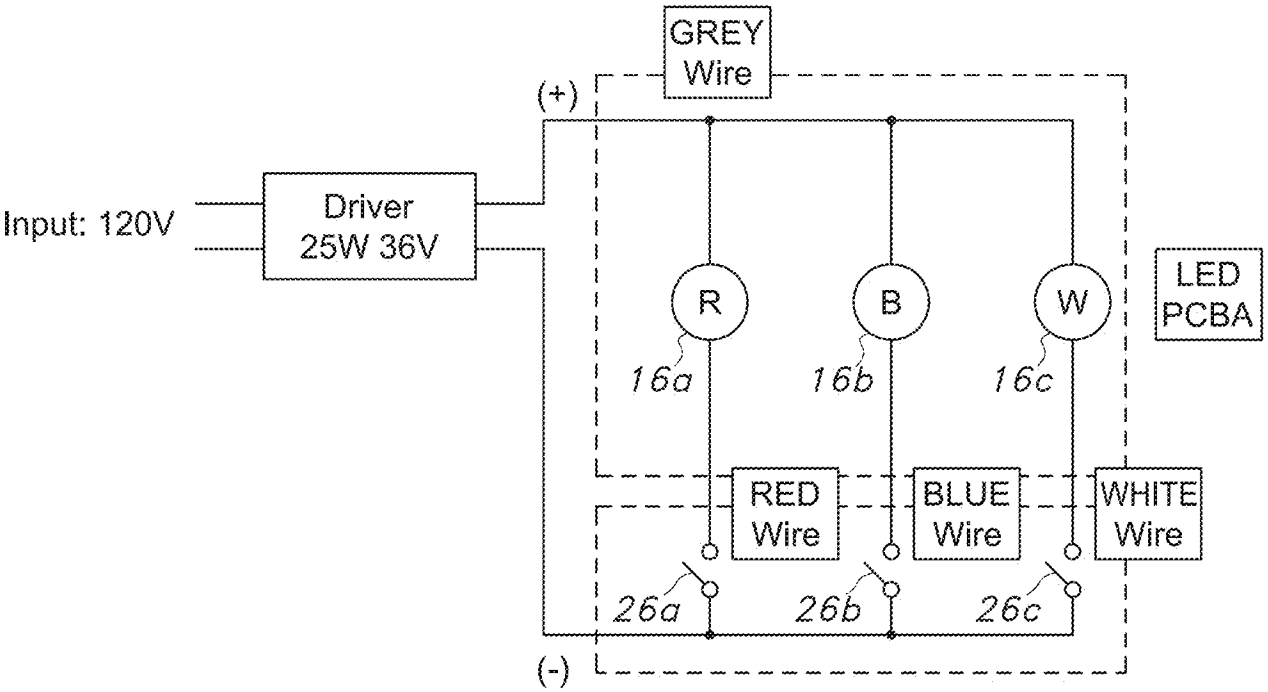
FIG. 5 schematically illustrates a circuit diagram for one embodiment of the light fixture.

An on/off switch 24 and a plurality of LED activation switches (collectively 26) may be provided on the fixture 10 for controlling light emission from the fixture 10. More specifically, a dedicated LED activation switch 26 may be provided to control the LEDs 16 of each color group. In the illustrated embodiment, three LED activation toggle switches 26 are provided on an end cap 22. A first LED activation switch **26*a* controls activation of the red LEDs 16*a*, a second LED activation switch 26*b* controls activation of the blue LEDs 16*b*, and a third LED activation switch 26*c* controls activation of the white LEDs 16*c*, as schematically represented by the circuit diagram of FIG. 5. The LED activation switches 26 can be, but do not have to be, colored to match the LED color they control. In use, the fixture 10 is turned on via the on/off switch 24, and the color of the light emitted from the fixture 10 is tailored as desired by selectively activating one or more colors of the LEDs 16 via the LED activation switches 26**.

The fixture 10 may be installed in any manner, including, but not limited to, suspended or flush-mounted. In some embodiments, for example, the fixture 10 may be flush mounted under a cabinet. The fixture 10 may be of any size, shape, and dimension. In some embodiments, the fixture 10 is one foot or two feet wide and two or four feet long. However, it could be narrower, wider, shorter and/or longer. Moreover, shapes other than a rectilinear fixture are contemplated.

In instances where a single fixture 10 is not sufficient for an installation, embodiments of the fixture 10 are equipped to easily connect to other fixtures to permit easy scaling up of the installation. More specifically, a rotatable power connector 30 (having a connector interface 32) may be provided at each end of the fixture 10. The power connectors 30 may be provided on the same side, but opposite ends of the fixture 10 or on different sides, but opposite ends of the fixture 10 (i.e., oriented diagonally from each other on the fixture 10).

In a first orientation (see FIG. 3), the power connector 30 is positioned to expose its connector interface 32 at an end wall 74, 76 of the fixture 10. In a second orientation (see FIG. 4), the power connector 30 can be rotated so as to expose its connector interface 32 at a side wall 70, 72 of the fixture 10.

Figure 6:
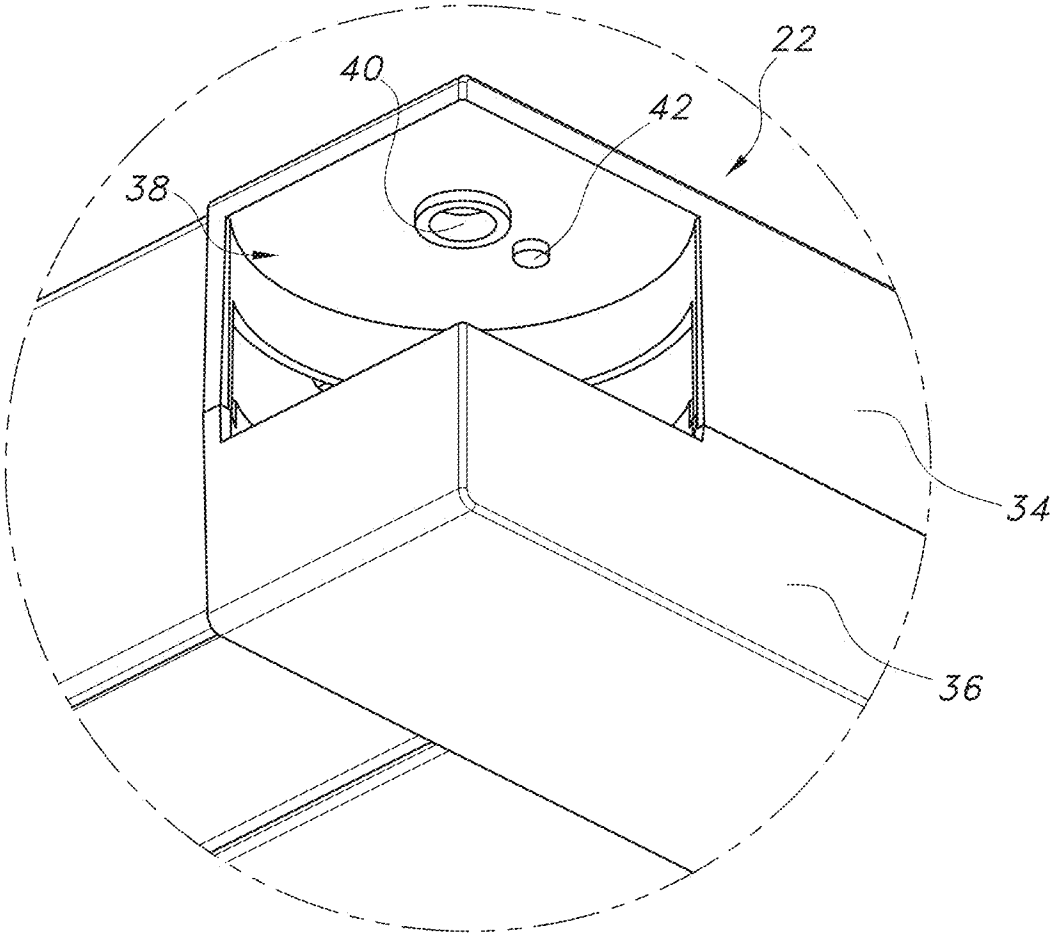
FIG. 6 is an enlarged bottom perspective view of an end cap with the adjustable power connector removed.
Figure 7:
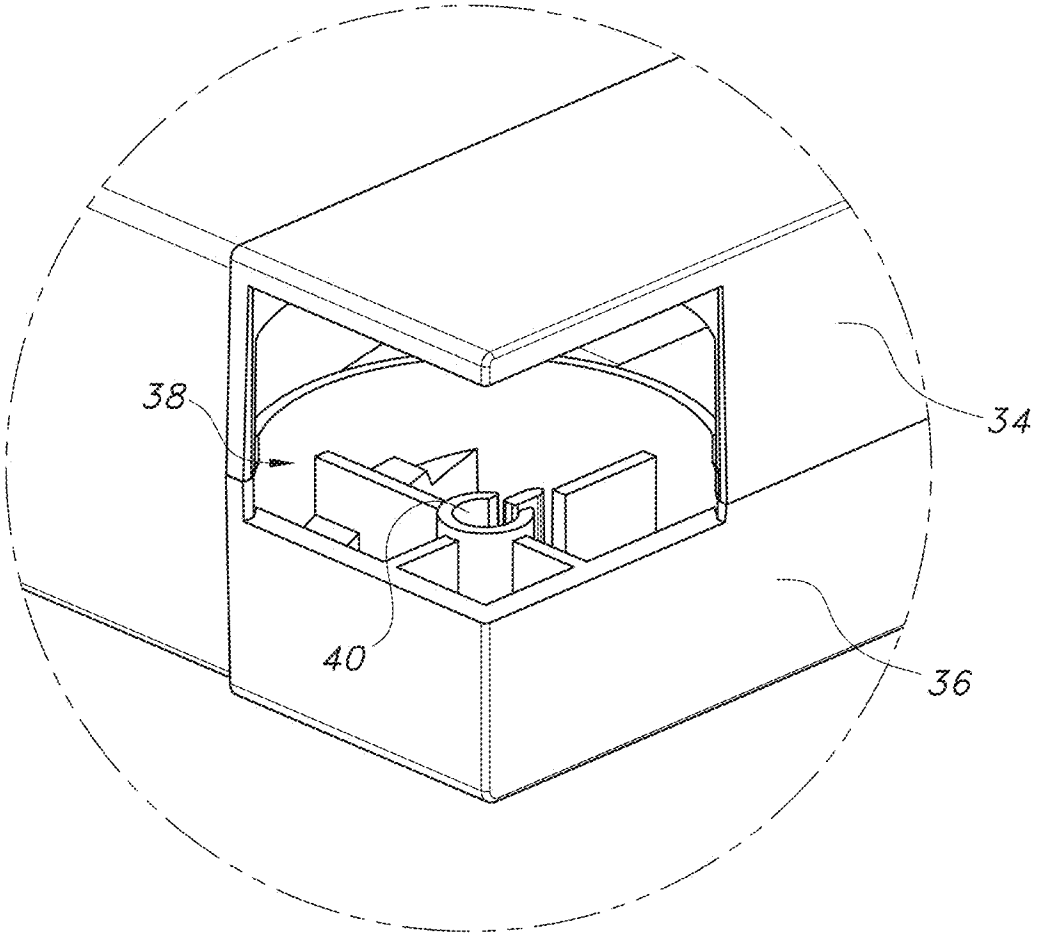
FIG. 7 is an enlarged top perspective view of the end cap of FIG. 6.
Figure 9:
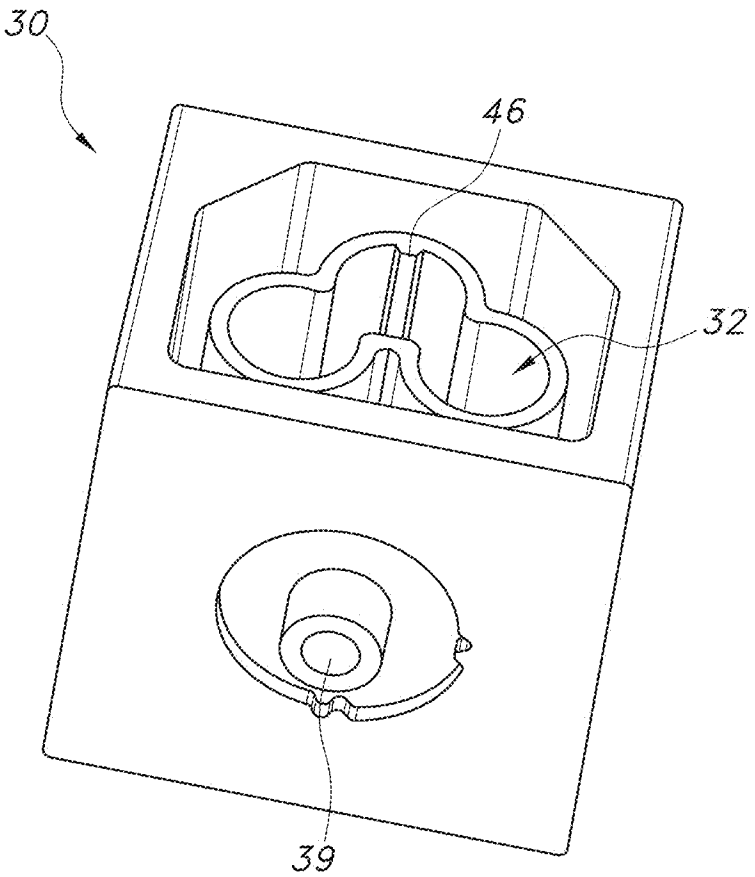
FIG. 9 is a bottom perspective view of the adjustable power connector of FIG. 8.
Figure 8:
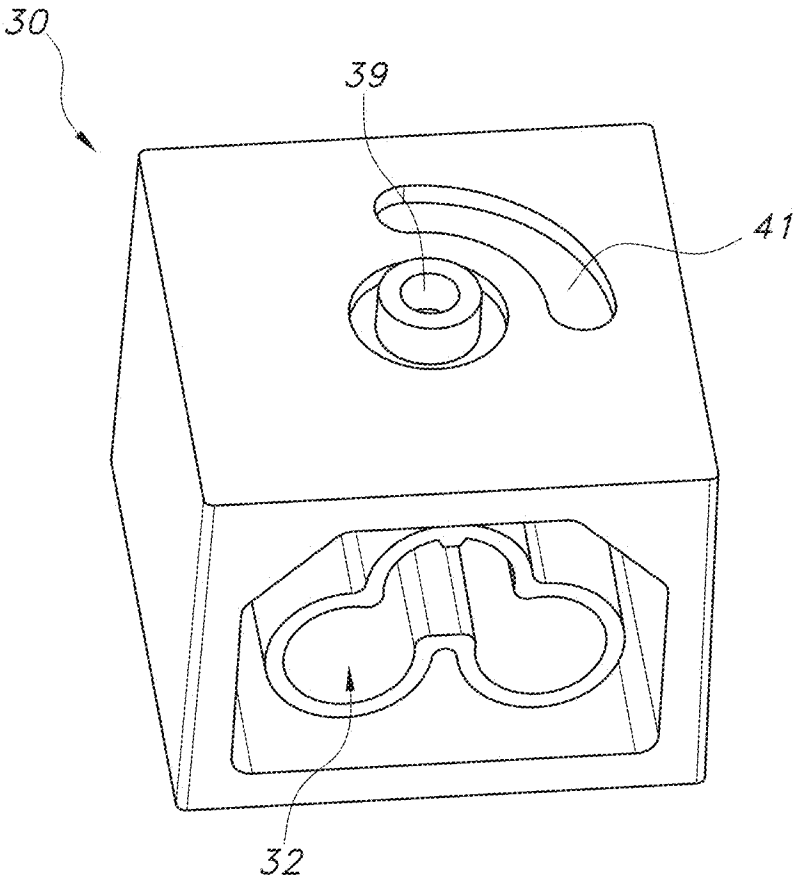
FIG. 8 is a top perspective view of an embodiment of an adjustable power connector shown in isolation.
Figure 12:
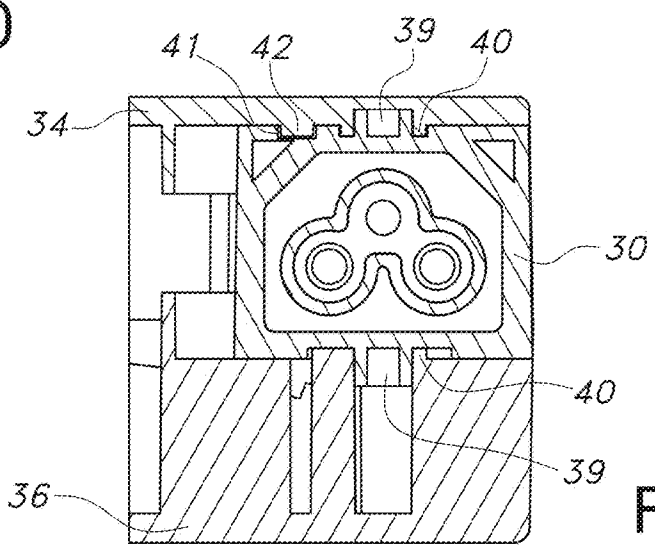
FIG. 12 is a cross-section taken along line 12-12 in FIG. 3.

In one embodiment, the end caps 22 on each end of the fixture 10 are formed of a top end cap portion 34 and a bottom end cap portion 36 coupled to the top end cap portion 34 to form each end cap 22. Before such coupling, the power connector 30 is positioned in a power connector cavity 38 (best seen in FIGS. 6 and 7) defined by the top and bottom end cap portions 34, 36. An aperture 40 is formed in each of the top and bottom end cap portions 34, 36. Pins 39 on the top and bottom of the power connector 30 (shown in isolation in FIGS. 8 and 9) engage the apertures 40 in the top and bottom end cap portions 34, 36 (see FIG. 12). The end cap portions 34, 36 may be secured together (via mechanical fasteners, snap-fitting, etc.) to retain the power connector 30. One of skill in the art will understand that other means many be used to secure the power connector 30 in an end cap 22 in a rotatable fashion.

In use, the power connector 30 rotates (via rotation of the pins 39 within the apertures 40) to alter the position of the connector interface 32. The power connector cavity 38 is sized and shaped to permit such rotation. Moreover, the extent to which the power connector 30 can rotate can be controlled. By way only of example, an arcuate slot 41 may be provided in the top (or bottom) of the power connector 30 and a tab 42 may be provided in the top (or bottom) end cap portion 34, 36 so as to seat in the slot 41 when the end cap portions 34, 36 are assembled around the power connector 30 (see FIG. 12). The slot 41 may have a geometry such that the power connector 30 can rotate only to a certain degree. The extent the power connector 30 is able to rotate may vary but in some embodiments the slot 41 permits only 90 degree rotation of the power connector 30—between positions whereby the connector interface 32 is exposed on an end wall 74, 76 and on a side wall 70, 72 of the fixture 10.

Figure 11:
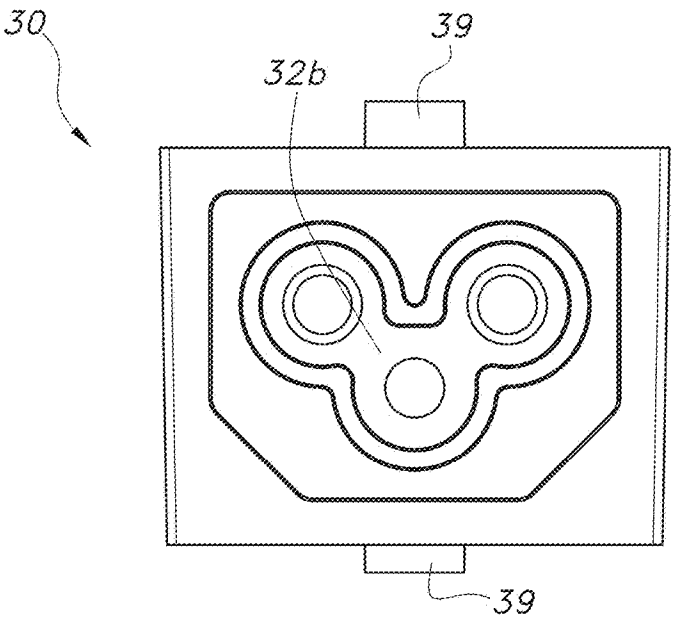
FIG. 11 is a side elevation view of an embodiment of a power connector in isolation and illustrating one embodiment of an output connector interface.
Figure 10:
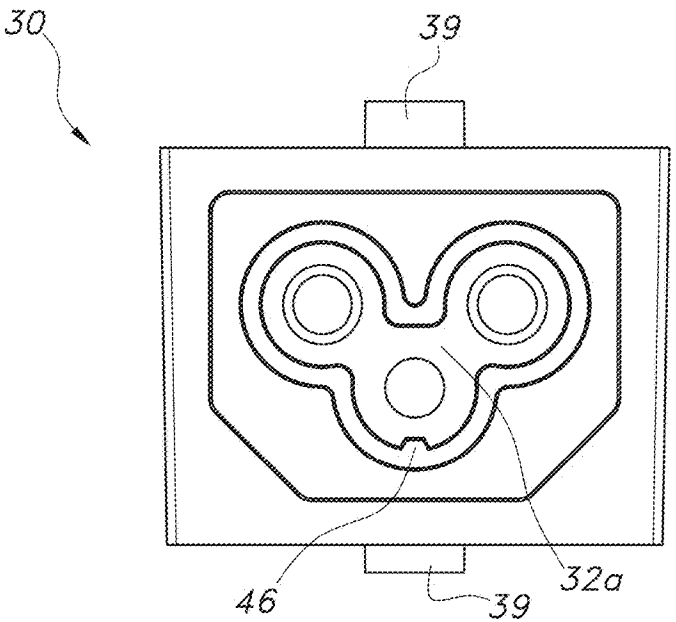
FIG. 10 is a side elevation view of an embodiment of a power connector in isolation and illustrating one embodiment of an input connector interface.
Figure 13:
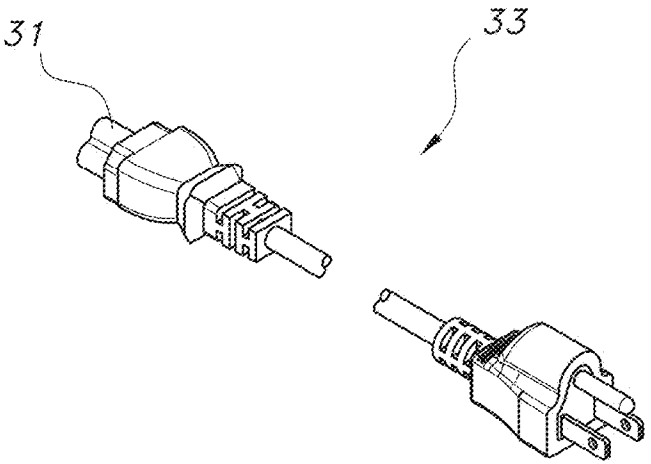
FIG. 13 is an embodiment of a power cord.
Figure 14:
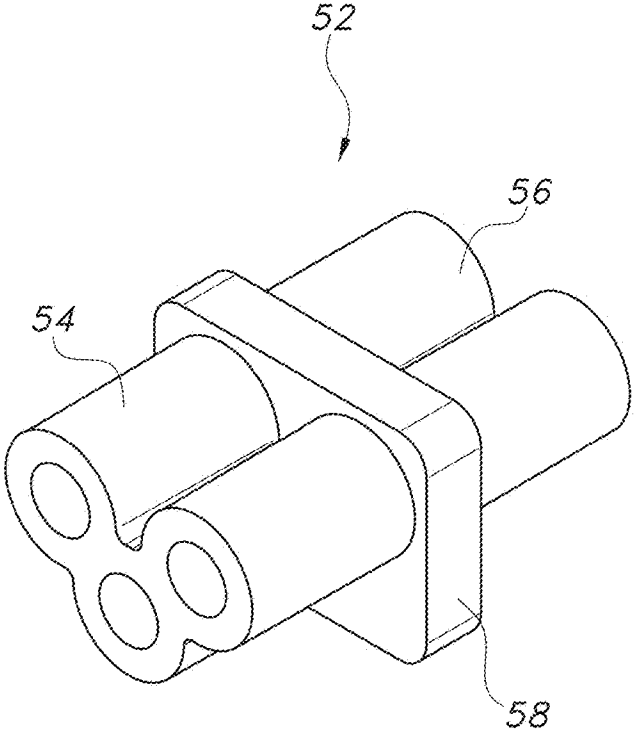
FIG. 14 is an embodiment of an input/output connector.

In some embodiments, the power connectors 30 on each end of the fixture 10 are identical. However, in some embodiments, the power connector 30 at a first end of the fixture 10 includes an input connector interface 32*a* (typically on the same end cap 22 as the on/off switch 24), and the power connector at the second, opposing end of the fixture 10 includes an output connector interface 32*b*. The input and output connector interfaces 32*a*, 32*b* may have different geometrical shapes or otherwise be structurally different to prevent input power from being inserted into the output connector interface 32*b* and vice versa, as can be seen by a comparison of the connector interfaces 32*a*, 32*b* of the power connectors 30 shown in FIGS. 10 and 11. For example, one of the input or output connector interfaces 32*a*, 32*b* may be keyed. By way only of example, the input connector interface 32*a* may include a ridge 46. A corresponding depression (not shown) to receive ridge 46 may be provided on the input power cord 33 (FIG. 13) and/or electrical connector 52 (see FIGS. 14 and 15) to ensure that input power is provided only to the input power connector 30 on a fixture 10. A ridge 46 or other structure may be provided on the output connector interface 32*b* as well as, or instead of, on the input connector interface 32*a* so long as each connector interface 32*a*, 32*b* is unique.

Figure 16:
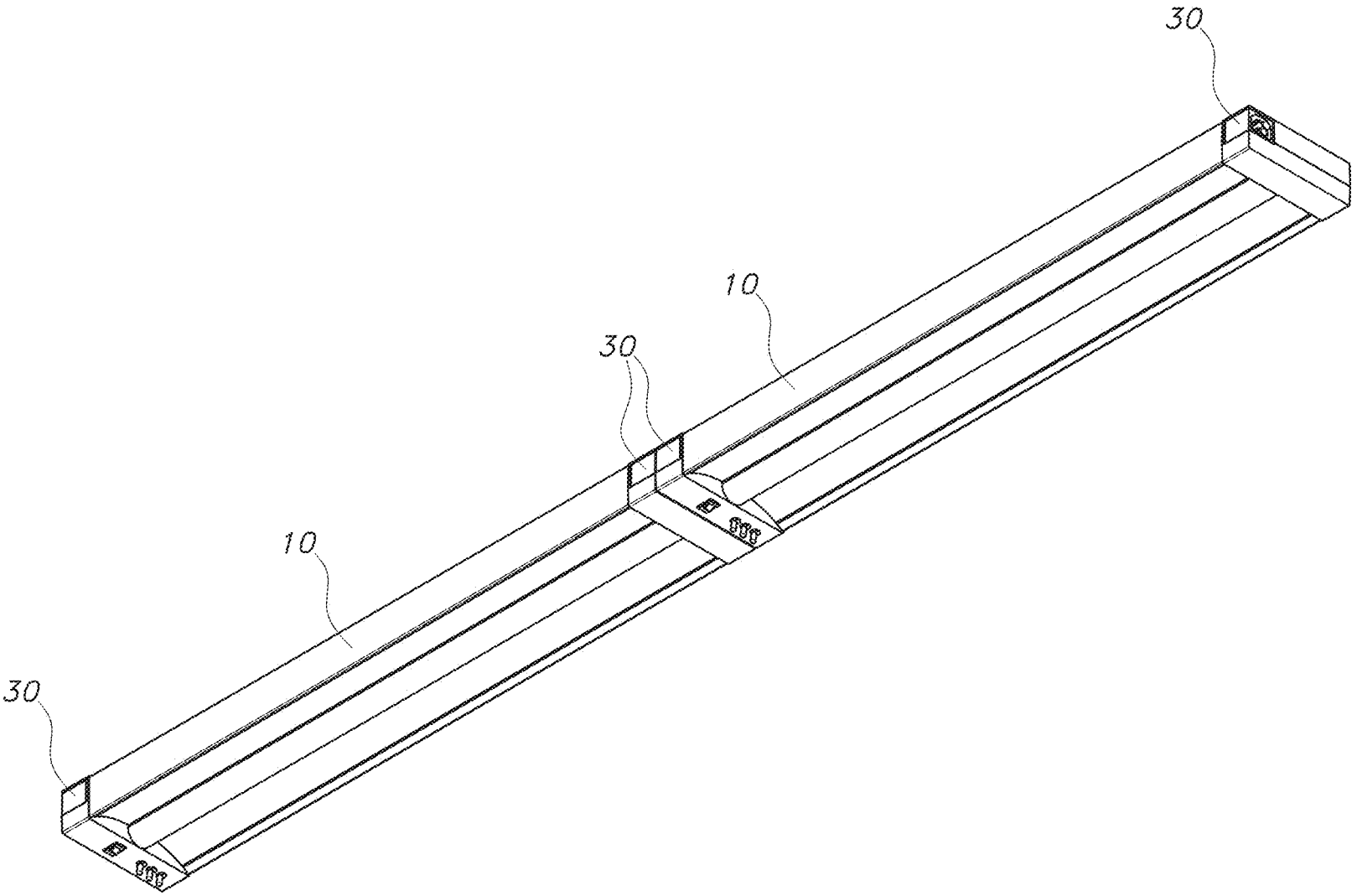
FIG. 16 is an embodiment of an installation with light fixtures oriented end-to end.

In use, an end 31 of a power cord 33 (FIG. 13) is inserted into the input connector interface 32*a* of a first fixture. A second fixture can be connected to the first fixture so as to draw power from the first fixture. In a first configuration (see FIGS. 16 and 17), the first and second fixtures are positioned end to end (co-axial) and the power connectors 30 on the adjacent ends can be oriented such that the output connector interface 32*b* of the first fixture and the input connector interface 32*a* of the second fixture are exposed at an end wall of each fixture 10.

Figure 15:
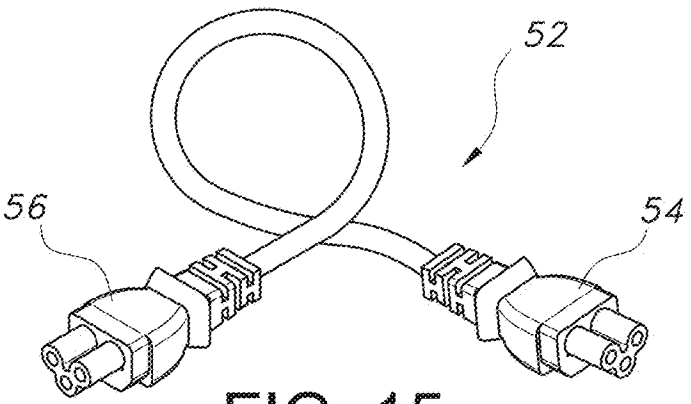
FIG. 15 is an alternative embodiment of an input/output connector.
Figure 17:
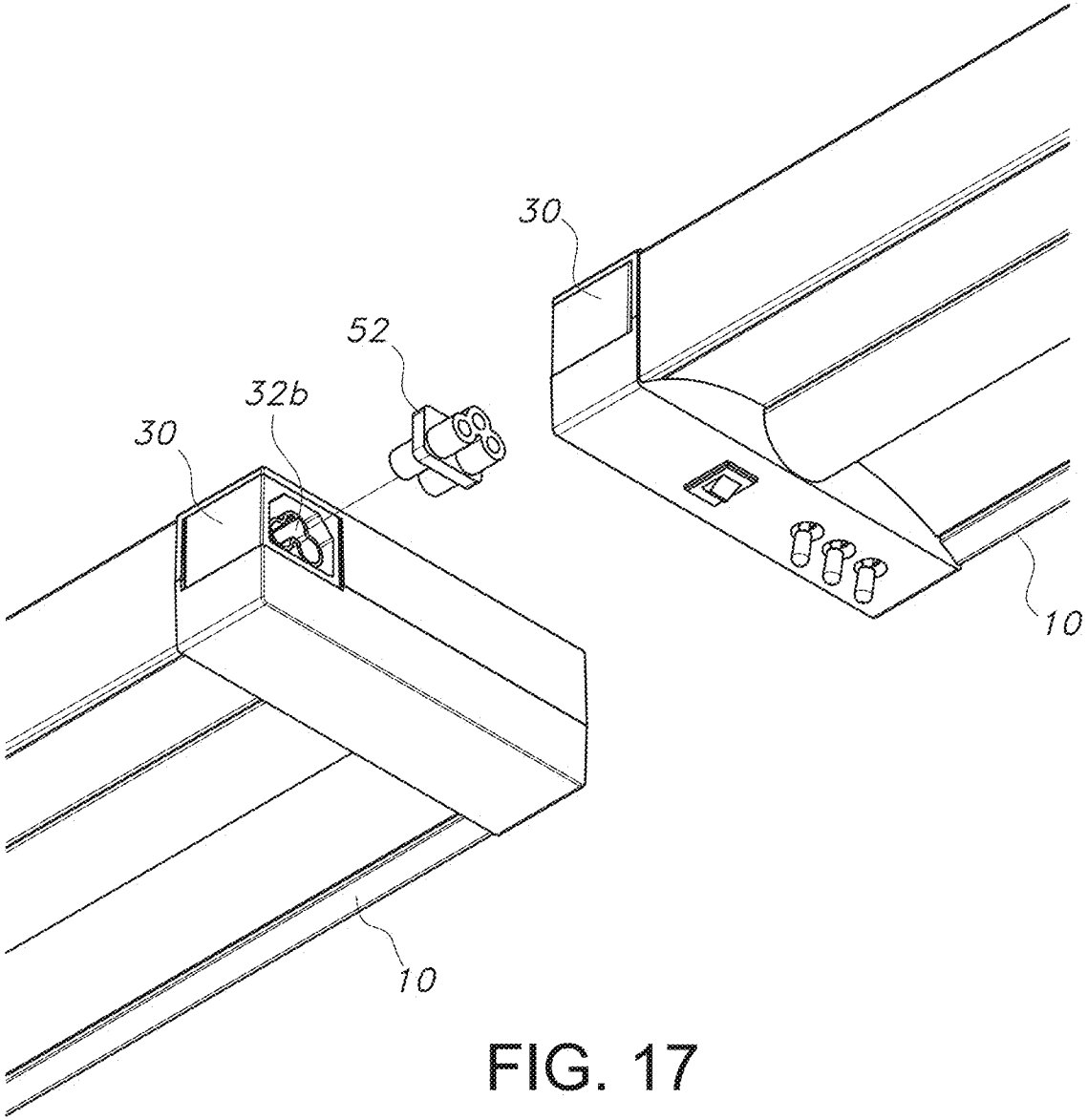
FIG. 17 is a partial exploded view of the installation of FIG. 16.

An electrical connector 52 (see FIG. 14) is used to electrically connect the fixtures together (such as via Molex or Amp connectors), as shown in FIG. 17. More specifically, the electrical connector 52 has an input side/plug 54 and an output side/plug 56 and a collar 58 interposed between the two sides/plugs. In use, the output side/plug 56 is inserted into the output connector interface 32*b* of the first fixture, and the input side/plug 54 is inserted into the input connector interface 32*a* of the second fixture to electrically connect the fixtures. Additional fixtures may be added to the installation in this same manner, by using an electrical connector 52 to connect the output and input connector interfaces 32*a*, 32*b* of adjacent fixtures. As shown in FIG. 15, the electrical connector 52 is also available as a length of cord (having an input side/plug 54 and output side/plug 56), which adds additional configuration flexibility in that fixtures need not be located directly adjacent to each other.

Figure 18:
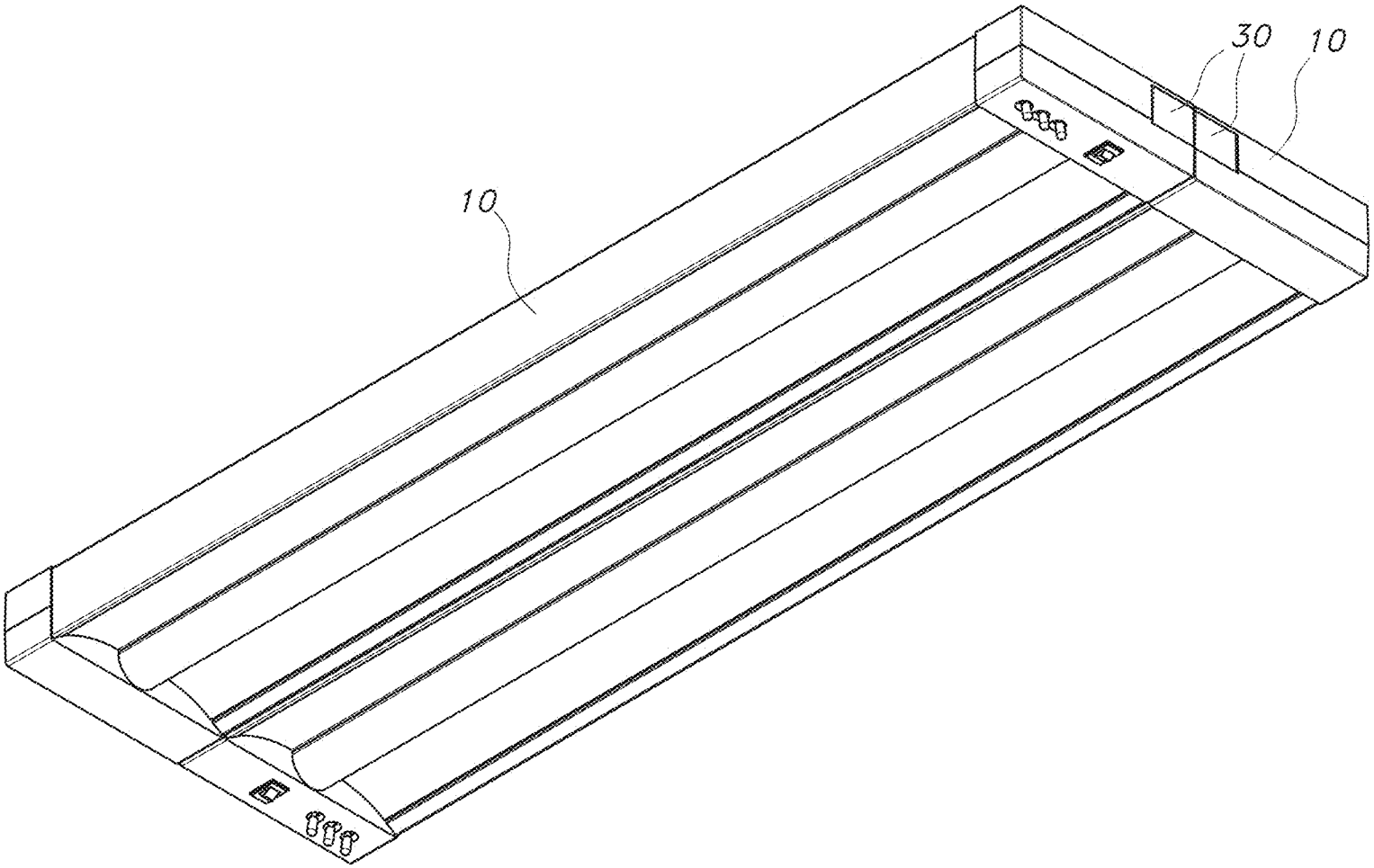
FIG. 18 is an embodiment of an installation with light fixtures oriented side-to-side.
Figure 19:
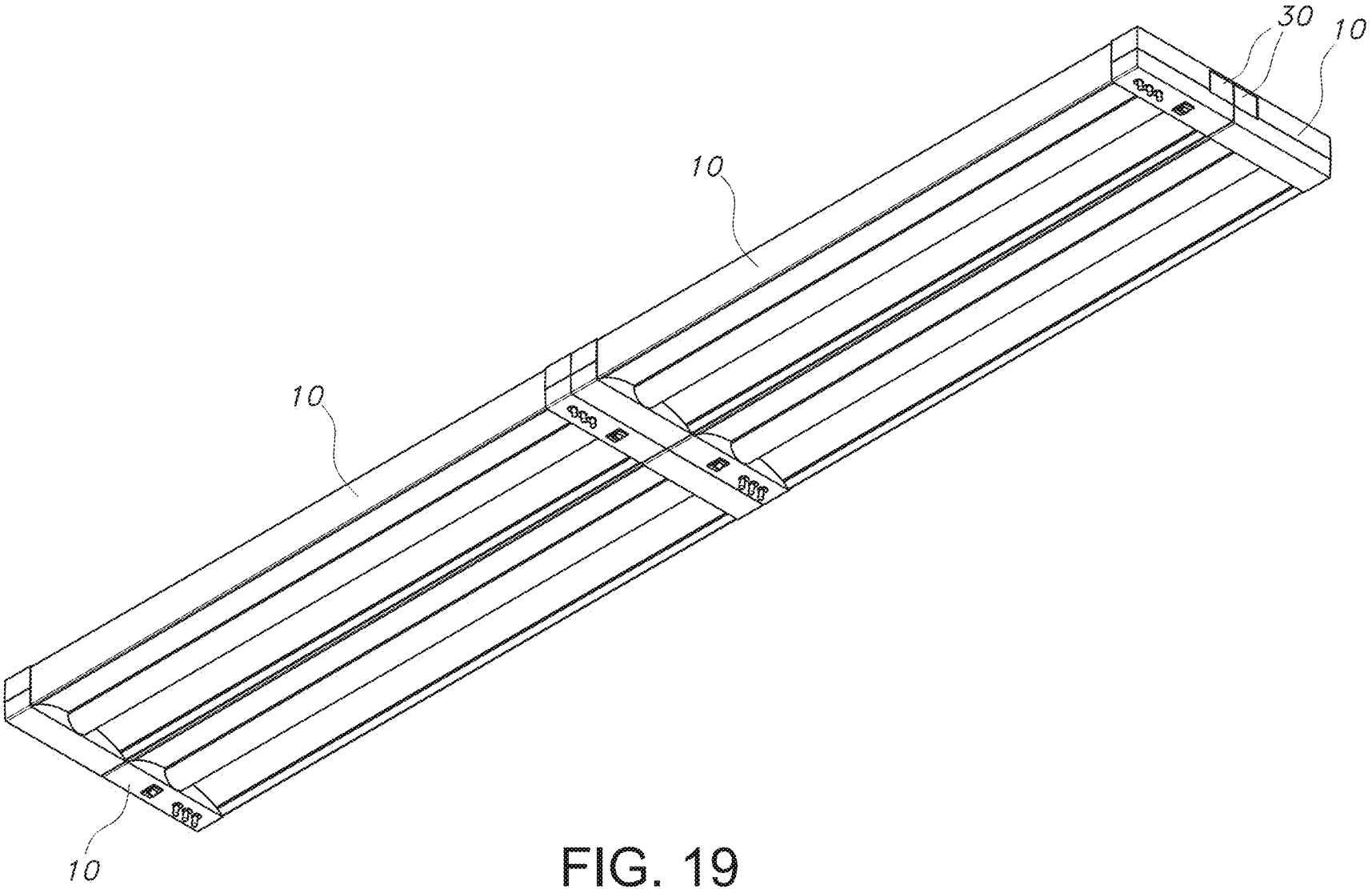
FIG. 19 is an embodiment of an installation with light fixtures oriented both end-to end and side-to-side.

In an alternative arrangement, the second fixture can be attached to the side (as opposed to end) of the first fixture, as shown in FIG. 18. The power connectors 30 of the first and second fixtures can be rotated so as to be exposed at a side wall of each fixture, with the output connector interface 32*b* of the first fixture aligned with the input connector interface 32*a* of the second fixture. The electrical connector 52 can then be used to electrically connect the first and second fixtures, as discussed above. If the fixtures are to be suspension mounted in this instance, it may be possible to use only a single mounting or installation kit (e.g., only one chain set) to hang both fixtures. Fixtures 10 may also be installed both end-to-end as well as side-to-side, as shown in FIG. 19.

Figure 20:
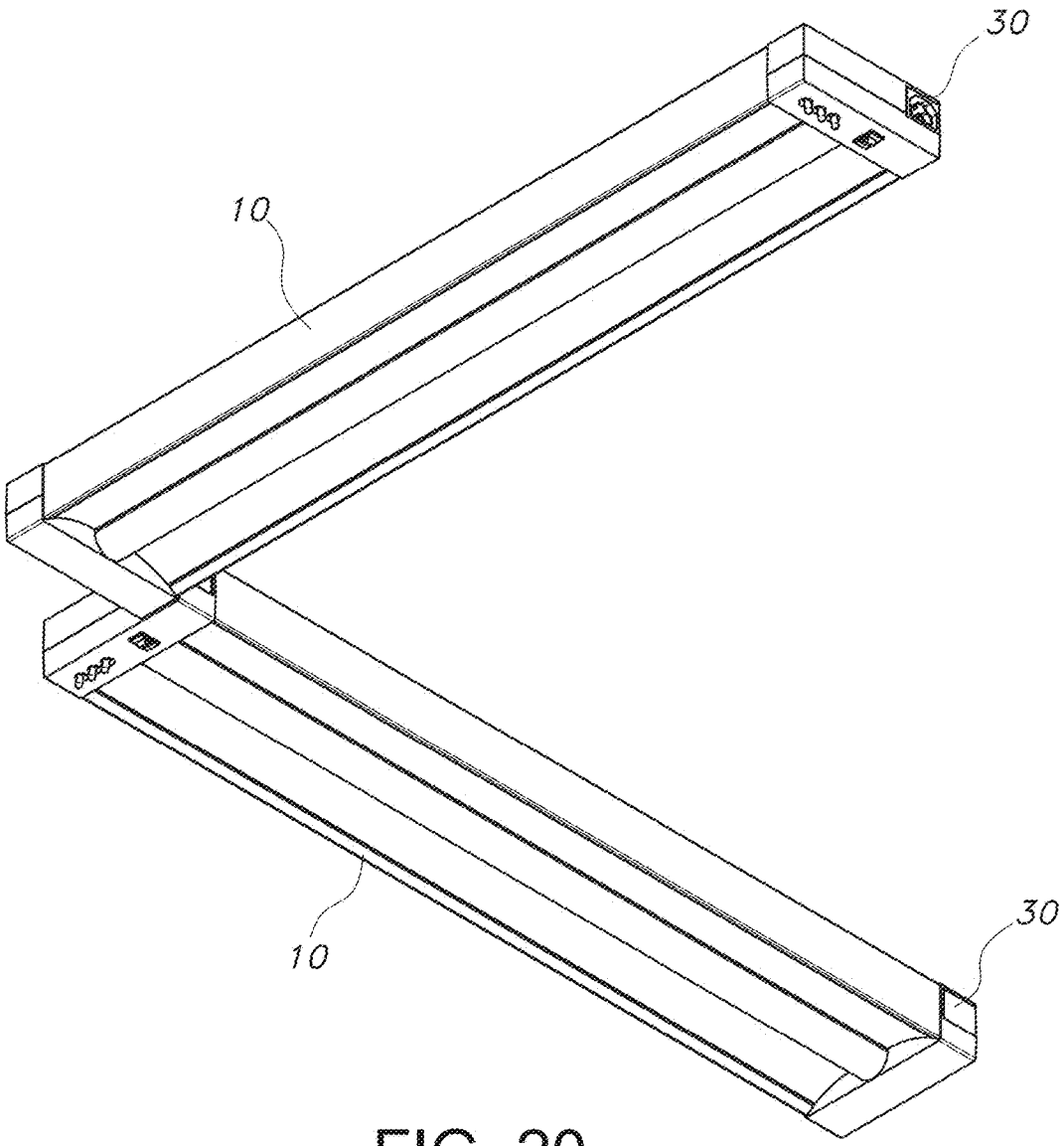
FIG. 20 is an embodiment of an installation with light fixtures oriented at an angle to each other.

In yet another embodiment (see FIG. 20), the second fixture can be attached at an angle relative to the first fixture. In some embodiments, the angle is 90° but other angles are contemplated. One way to accomplish this is to orient the power connector 30 on one fixture so as to be exposed on an end wall of the fixture and orient the power connector 30 on the other fixture so as to be exposed on a side wall of the fixture. Other ways may also be possible.

Again, any number of fixtures may be connected together to form an installation. It is contemplated that not all of the fixtures in an installation be identical. Rather, fixtures having different shapes, configurations, sizes, etc. may be joined together in a single installation. Moreover, some installations will include fixtures installed in different configurations (i.e., end-to-end, side-to-side, at an angle, or combinations of any or all three ways) so as to permit a wide variety of different installation layouts.

While light fixtures 10 have been disclosed having a power connector 30 on each end, it is contemplated that some fixtures 10 may have a power connector 30 on a single end. Moreover, it is also contemplated that more than one power connector 30 may be provided on one or both ends of a fixture 10. Moreover, it is also contemplated that the power connectors 30 disclosed herein may be provided on a fixture 10 at locations other than the end caps 22.

Furthermore, the geometry of the connector interfaces 32 (input 32*a* and output 32*b*) on the power connectors 30 as well as the corresponding geometry of the input side/plug 54 and output side/plug 56 of the electrical connector 52 are not limited to the geometries illustrated herein. Rather, they may have other geometries that effectuate electrical connection between adjacent fixtures 10.

The ability to connect fixtures end-to-end, side-to-side, and/or at angles relative to each other allows an installer to design and create a lighting installation tailored to a particular application. Moreover, the design of the fixtures imparts versatility that permits the installer to scale the installation up or down as needed.

The foregoing is provided for purposes of illustrating, explaining, and describing embodiments of the present invention. Further modifications and adaptations to these embodiments will be apparent to those skilled in the art and may be made without departing from the scope or spirit of the invention. Different arrangements of the components depicted in the drawings or described above, as well as components and steps not shown or described are possible. Similarly, some features and subcombinations are useful and may be employed without reference to other features and subcombinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications can be made without departing from the scope of the invention.

We claim:

1. A light fixture comprising:

a. a housing comprising opposing side walls and opposing end walls;

b. a plurality of light sources; and c. at least one power connector having a connector interface, wherein the at least one power connector is rotatable within the housing such that in a first position the connector interface is exposed on one of the opposing end walls of the housing and in a second position the connector interface is exposed on one of the opposing side walls of the housing.

2. The light fixture of claim 1, wherein the at least one power connector comprises a first power connector and a second power connector, wherein the first power connector is rotatable within the housing such that in a first position the connector interface of the first power connector is exposed on one of the opposing end walls of the housing and wherein the second power connector is rotatable within the housing such that in a first position the connector interface of the second power connector is exposed on the other of the opposing end walls of the housing.

3. The light fixture of claim 1, wherein the housing comprises a channel and opposing end caps positioned on each end of the channel and wherein the at least one power connector is positioned within at least one of the opposing end caps.

4. The light fixture of claim 1, wherein the plurality of light sources comprise light emitting diodes and wherein a first subset of the light emitting diodes emit light of a color different from a color emitted by a second subset of the light emitting diodes.

5. The light fixture of claim 2, wherein the connector interface of the first power connector has a shape different from a shape of the connector interface of the second power connector.

6. The light fixture of claim 5, wherein the connector interface of the first power connector is keyed.

7. The light fixture of claim 3, wherein the at least one power connector comprises a first power connector and a second power connector, wherein the first power connector is positioned within one of the opposing end caps and wherein the second power connector is positioned within the other of the opposing end caps.

8. The light fixture of claim 3, wherein the at least one of the opposing end caps comprises a top end cap portion and a bottom end cap portion coupled to the top end cap portion, wherein the at least one power connector resides within a power connector cavity formed by the top end cap portion and the bottom end cap portion.

9. The light fixture of claim 8, wherein the at least one power connector comprises at least one pin and wherein at least one of the top and bottom end cap portions comprises an aperture, wherein the at least one pin engages the aperture.

10. The light fixture of claim 4, wherein the first subset of the light emitting diodes are activated independently of the second subset of the light emitting diodes.

* * * * *